US005134858A

United States Patent [19]

Abbondanzo

[11] Patent Number: 5,134,858

[45] Date of Patent: Aug. 4, 1992

[54] METHOD OF AND APPARATUS FOR SHIPPING FLORAL ARRANGEMENTS

[76] Inventor: Maria V. Abbondanzo, 608 First Ave., Columbus, Ga. 31901

[21] Appl. No.: 525,769

[22] Filed: May 21, 1990

[51] Int. Cl.[5] ..... F25D 3/08

[52] U.S. Cl. ..... 62/457.2; 62/466

[58] Field of Search ..... 47/84; 206/423, 813; 62/459, 466, 457.2, 465, 60, 62

[56] References Cited

U.S. PATENT DOCUMENTS 2,187,387 1/1940 Trigg et al. ..... 62/466
2,763,134 9/1956 McDonald ..... 62/459 X
3,762,097 6/1973 Gallo .
4,075,786 6/1978 van Zyl .
4,170,301 11/1979 Jones et al. .
4,508,223 4/1985 Catrambone .
4,561,262 5/1985 Fredrixon .
4,742,644 5/1988 Groth et al. .

*Primary Examiner*—Henry A. Bennet
*Attorney, Agent, or Firm*—Wigman & Cohen

[57] ABSTRACT

An apparatus and method for shipping floral arrangements are disclosed. An insulated container with a hinged or removable lid is provided with a recess in its bottom wall for receiving a cooling medium comprising one or more ice substitute packs. Straps are provided for releasably fastening the cooling packs in the recess. A mounting arrangement is also provided for securing a floral arrangement, such as a wedding bouquet, in close proximity to the cooling medium such that the flowers avoid contact with the side walls, top or bottom of the container during shipment.

20 Claims, 2 Drawing Sheets

FIG. 3
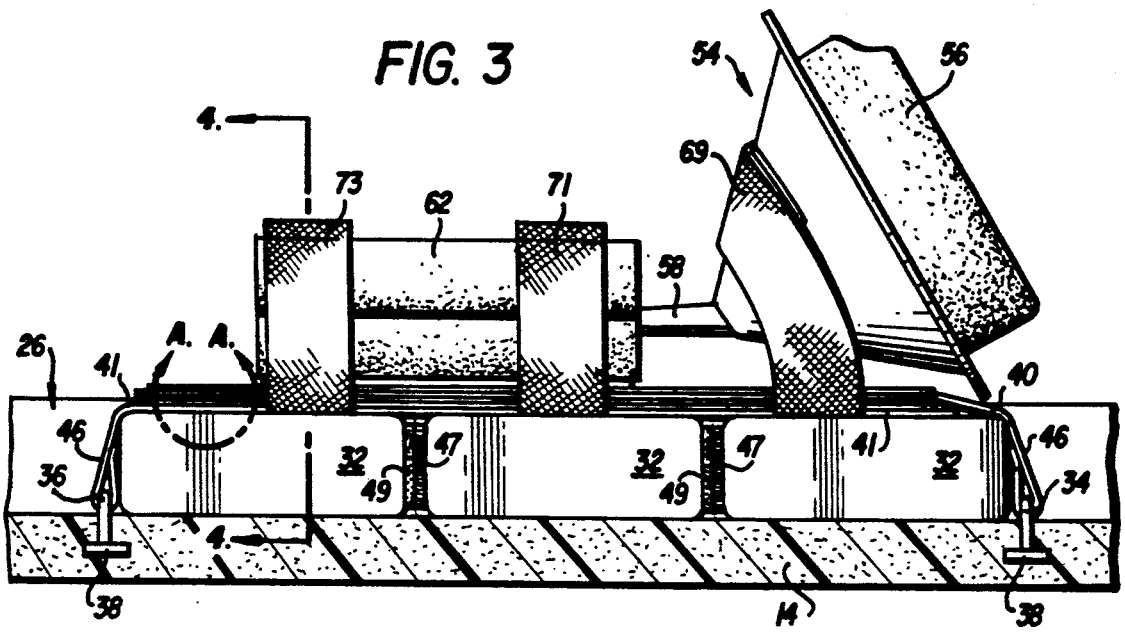
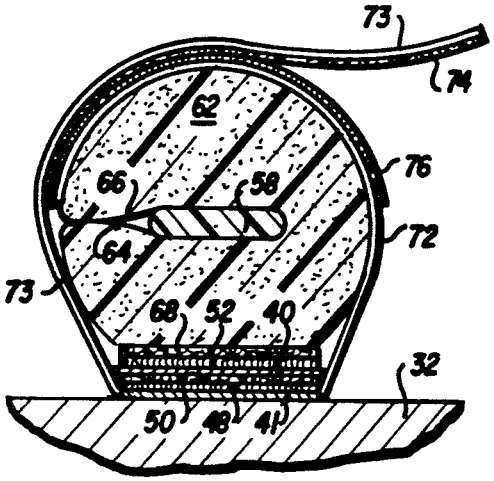
FIG. 4
FIG. 5
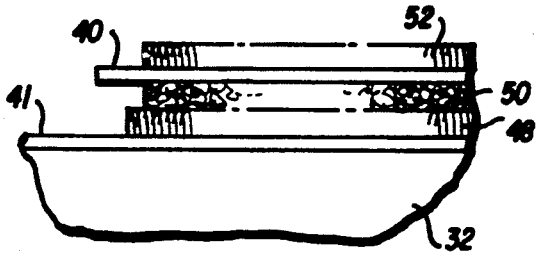
FIG. 6
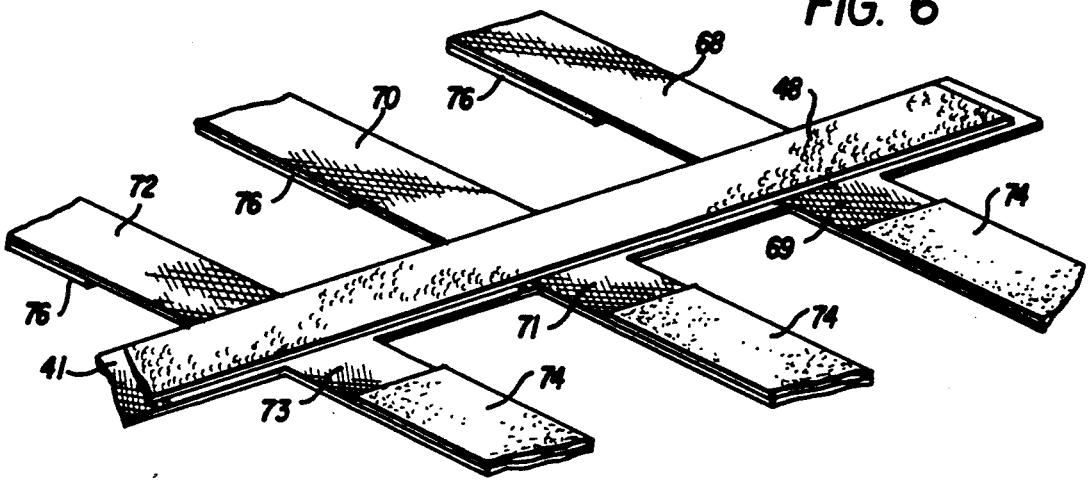

METHOD OF AND APPARATUS FOR SHIPPING FLORAL ARRANGEMENTS

FIELD OF THE INVENTION

The present invention relates to a method of and a container apparatus for shipping a floral arrangement, flower bouquet or the like, and more particularly to a thermally insulated shipping container which incorporates a cooling medium to prevent the flowers from withering and a unique mechanism for preventing damage to the flowers during transit.

DESCRIPTION OF THE PRIOR ART

In an effort to preserve flower bouquets and similar floral arrangements from special occasions, such as weddings and other memorable events, an industry has emerged which specializes in the preservation of these flower arrangements. One known preservation process is freeze drying wherein the flowers are rapidly frozen and dried in a vacuum. Then, after a moisture proofing treatment, the flowers are mounted in an airtight and moisture-resistant case for display. However, in order to effectuate an accurate preservation with the flowers at the peak of beauty, the freeze drying process must be initiated before the flowers begin to wilt.

Because facilities which perform floral preservation are few in number and may not be located in close proximity to persons who wish to avail themselves of this service, the floral arrangement often must be shipped from locations far away from the facilities. If not carefully packaged, the floral arrangements may also be damaged in transport as a result of being crushed or moved about in the shipping container.

The long transports also may result in the withering and wilting of the flowers making quality preservation difficult. Shipping the floral arrangement in a refrigerated transport vehicle will significantly delay the withering process, but this method may be prohibitively expensive for many individuals.

While portable refrigerated shipping containers exist in the prior art, such apparatus are too complex and expensive for use by the floral preservation industry which must send out containers to each of its many customers.

The shipping container for deep frozen goods disclosed in U.S. Pat. No. 4,561,262 to Fredrixon, for example, uses tanks adapted to be filled with a freezing medium, such as liquid nitrogen or carbon dioxide. The tanks of this container require a piping system with nozzles, valves and other piping components. It is also known to transport perishable food products, such as hams, live lobsters and the like, in rigid foam containers, such as styrofoam containers, loosely packed with one or more packets of a refreezable liquid sometimes referred to as "blue ice". Such containers are designed for one-way shipment and consequently are of relatively low quality and do not provide a means for preventing contact between the ice packets and the perishable products being shipped.

SUMMARY OF THE INVENTION

In view of the foregoing, it should be apparent that a need still exists in the art for a shipping container for floral arrangements which will retard the withering process and otherwise prevent or lessen damage to the flowers during transport.

Accordingly, it is a primary object of this invention to provide a floral arrangement shipping container which will keep the flowers contained therein refrigerated without the need for expensive or complex refrigeration apparatus and which will protect the flowers from damage during transport.

Another object of this invention is to provide a floral arrangement shipping container with means to effectively restrain the floral arrangement to prevent it from being tossed about during transport, but wherein the restraining means causes no damage to the flowers.

Yet another object of the invention is to provide a reusable floral arrangement shipping container which is lightweight, easy to carry, and is constructed of inexpensive yet rugged materials so that the floral preservation industry can provide shipping containers to their customers without significant expense.

Still another object of the present invention is to provide a method of maintaining a floral arrangement in a relatively fresh and undamaged state during transit from one place to another so that the floral arrangement will be kept suitable for preservation, for example, in a freeze-drying process.

Briefly described, the aforementioned objects are accomplished according to the invention by providing an insulated, substantially rectangular parallelepiped container, preferably fabricated of a molded styrofoam, with a hinged or removable lid or top wall and a recess in the bottom wall thereof for receiving a cooling means comprising one or more packets or blocks of a refreezable liquid. Means are provided for releasably but securely fastening the cooling means in the recess. Means are also provided for securing a floral arrangement, such as a wedding bouquet, in close proximity to the cooling means such that few or none of the flowers of the bouquet come in contact with the side walls, top or bottom walls of the container during shipment. The positioning of the flowers in close proximity to the fixed cooling medium but spaced from the walls of the container provides the necessary cooling to maintain the freshness of the flowers, as well as the necessary protection of the flowers from damage owing to contact between the flowers and the cooling medium or the container walls.

According to the method of the invention, when it is desired to prepare a floral arrangement, such as a wedding bouquet, for shipment, the cooling medium in its frozen condition is positioned and secured in the recess in the bottom of the container. The bouquet is then secured in place closely adjacent the cooling medium with a sufficient free space between the flowers of the bouquet and the container walls. The container lid is then closed and sealed for shipment.

With the foregoing and other objects, advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 3 is a side elevation view partly in section of the bouquet holder, mounting element, and ice packs shown secured to the bottom of the shipping container;

FIG. 4 is a cross-sectional view of the mounting element and hold-down straps taken along line 4—4 of FIG. 3;

FIG. 5 is an enlarged view of detail A of FIG. 3; and

FIG. 6 is a perspective view, partially fragmented, of the hold-down straps for the bouquet holder and mounting element.

DETAILED DESCRIPTION OF THE INVENTION

Figure 1:
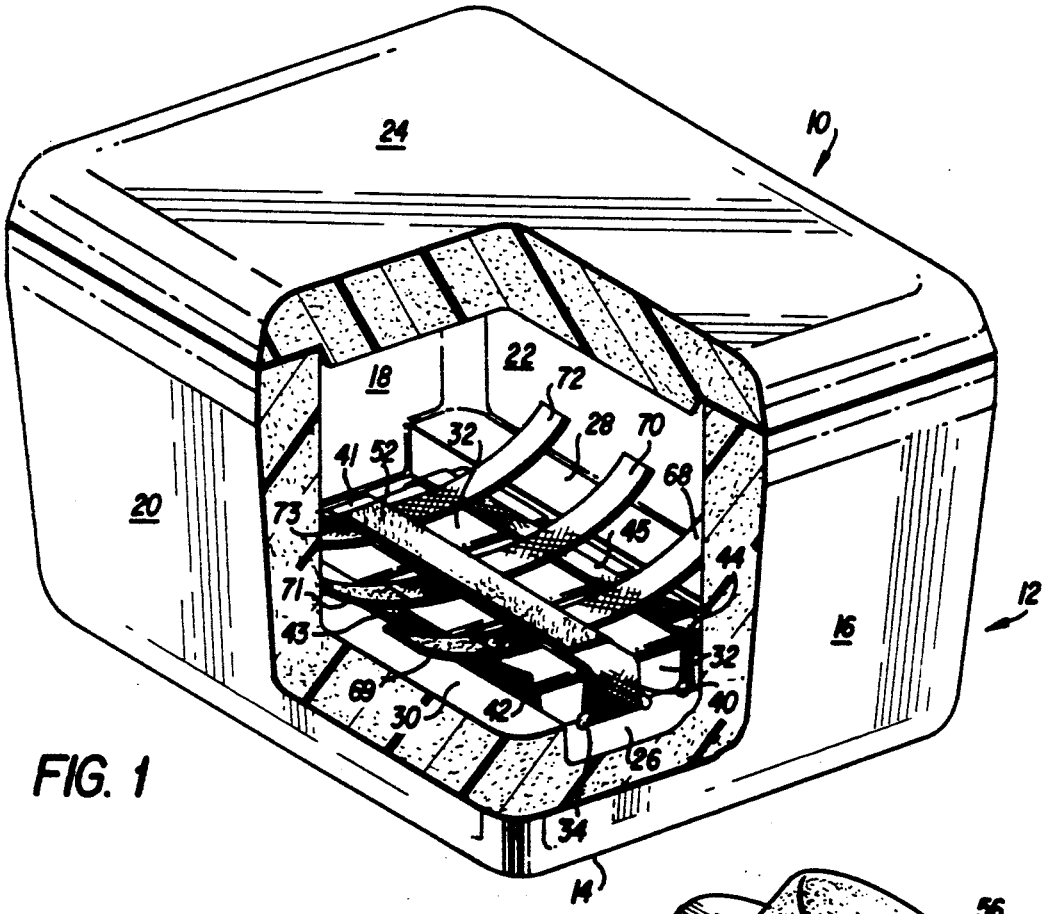
FIG. 1 is a perspective view of the shipping container of the invention having a portion broken away.

Referring now in detail to the drawings wherein like parts are designated by like reference numerals throughout, there is illustrated in FIG. 1 a perspective view of the shipping container designated generally by reference numeral 10 having a portion broken away to show the internal arrangement of the elements. Shipping container 10 comprises a housing 12 having a generally rectangular parallelepiped configuration including a bottom wall 14 and four side walls 16, 18, 20, 22. A cover 24 engages over the open side of housing 12 and may be either removable or, alternatively, hingedly mounted to the housing along one side wall thereof by means of hinges or a flexible tape (not shown). Both the housing 12 and cover 24 are preferably constructed of a semi-rigid polystyrene plastic, such as Styrofoam, or a similar semi-rigid insulating material.

The bottom wall 14 of the housing 12 has a central longitudinal recess 26 defined by a pair of opposing abutments 28, 30. Abutments 28, 30 may be molded into the bottom wall of the housing or may be provided as separate blocks of material bonded in place along the side walls 20, 22.

A cooling means comprising a plurality of ice substitute packs 32 are centrally positioned in the recess 26 between two groups of strap tie-down bars 34, 36. Three tie-downs are located in line at each side of the two outermost packs 32. (FIG. 3.) Tie-down bars 34, 36 are preferably provided with anchoring elements 38 which are molded in place in the bottom wall 14 of the housing as shown best in FIG. 3. The tie-downs may however be secured to the bottom wall in any other suitable manner, such as by bonding or by fasteners passing through and secured to the bottom wall of the housing.

The cooling medium contained in packs 32 is preferably a reusable and refreezable ice substitute material having a freezing point below that of water. Such materials, commonly known as "blue ice" are readily available from a number of sources. One such material that may be employed is known as "Freez Pak" available from Lifoam Leisure Products of Baltimore, Md.

Packs 32 are secured to the bottom wall of housing 12 by a pair of central straps 40, 41, and two pair of side straps 42, 43, and 44, 45. Each strap of the strap pairs 40–41, 42–43 and 44–45 preferably has a loop 46 formed in one end thereof through which a respective tie-down bars 34, 36, passes to secure the strap to the bottom wall of the housing. Each strap 40–45 is preferably provided with a hook-and-loop fabric fastener, such as Velcro ®, so that each pair of straps 40–41, 42–43 and 44–45 may be fastened together as shown in FIG. 1 to retain the ice packs 32 securely in place in the recess 26.

To further stabilize and secure the ice packs 32, the confronting surfaces between the packs may be provided with Velcro ® strips 47, 49 so that each pack is secured to the pack adjacent thereto as shown in FIG. 3.

Referring now to FIG. 5 which shows an enlarged detail A of FIG. 3 illustrating the manner in which the central pair of straps 40, 41 are secured with the hook-and-loop fabric. As shown the lowermost strap 41 is provided on its upper surface with a hook fabric 48 and the uppermost strap 40 is provided on its lower surface with a loop fabric 50 which fastens to the hook fabric in the conventional manner. Upper strap 40 is also provided on its upper surface with a hook fabric 52 for a purpose to be described hereinafter. As will be apparent to those skilled in the art, the confronting surfaces of the strap pairs 42, 43 and 44, 45 are provided with a respective hook or loop fabric for fastening together the straps of each pair to secure the ice packs 32 in place.

In an alternative embodiment (not shown) of the strap means for securing the ice packs to the bottom wall of the housing, the strap pairs 40–41, 42–43, 44–45 may each comprise a single strap the ends of which pass through slots in the bottom wall of the housing at the locations of the tie-down bars and then over the packs 32 where they are fastened by hook-and-loop fasteners such as described above or by other suitable fastening means, such as snaps, buckles or the like.

Figure 2:
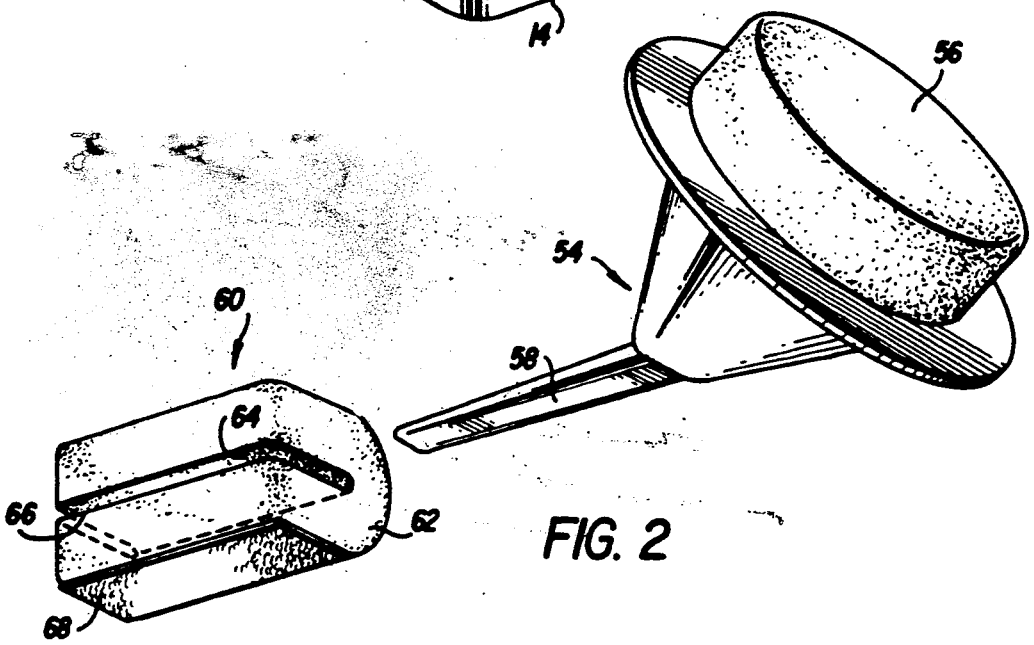
FIG. 2 is a perspective view of a bouquet holder and mounting element.

Now referring to FIG. 2 there is shown one type of floral arrangement that may be shipped in the container 10 of the present invention. In this case, the floral arrangement is a bride's wedding bouquet which is typically supported by a bouquet holder 54 of conventional construction. Holder 54 comprises a cup portion 56 for mounting the flowers (not shown) and a handle portion 58 which would normally be gripped by the bride at a wedding.

A mounting element 60 for the holder 54 comprises a resilient rectangular pad 62 of relatively soft, flexible foam rubber which has been folded over onto itself as shown so that confronting surfaces 64, 66 of the pad 62 engage and grip the handle portion 58 of the flower holder 54 or handles of other sizes. A strip 68 of loop fabric is attached to one side of the pad adjacent an edge thereof for a purpose to be described. While the mounting element 60 has been shown and described as a folded-over rectangular pad of foam rubber, other materials and shapes may be employed so long as they perform the function of securely gripping the handle portion 58 of the holder 54 or component of the floral arrangement to be shipped whatever its form or configuration.

Referring now to FIG. 6, it will be seen that the lowermost strap 41 of the central strap pair 40, 41 has three strap pairs 68–69, 70–71 and 72–73 extending transversely from each side of strap 41. The three transverse straps 69, 71, 73 are provided with a hook fabric 74 and the three transverse straps 68, 70, 72 are provided with a cooperating loop fabric 76 for fastening the respective strap pairs together. Alternatively, the transverse strap pairs may be separate straps sandwiched between the hook-and-loop fabrics 48, 50 of the straps 40, 41.

FIGS. 3 and 4 illustrate the manner in which the flower or bouquet holder 54 is secured in place inside the housing 14 in close proximity to the cooling means 32 by means of the strap pairs 68–69, 70–71 and 72–73. The bouquet holder 54 with the handle portion 58 thereof inserted in the pad 62 and gripped between opposing pad surfaces 64, 66 (FIGS. 2 and 4) is located on the uppermost central strap 40 with the loop fabric strip 68 of the pad in the approximate position shown in FIG. 3. The loop fabric strip 68 is engaged with the hook fabric strip 52 (FIG. 5) on the upper side of strap 40 and the two transverse strap pairs 70–71 and 72–73 are tightly wrapped about the folded over pad 62 and fastened with the hook-and-loop fabric 74, 76 to securely hold the pad and the handles of the bouquet holder in place. The third transverse strap pad 68–69 is wrapped about the cup portion 56 of the holder 54 to provide additional securement for the bouquet holder.

The strip of hook fabric 52 on the upper surface of strap 40 extends substantially the entire length of the strap 40 so that it is possible to adjust to some extent the position of the pad and bouquet holder to accommodate a somewhat larger flower bouquet or a different size or design bouquet holder. Other suitable arrangements of the means for securing the bouquet in place will be apparent to those skilled in the art based on the embodiments disclosed herein so long as the important aspects and features of the invention are accomplished. For example, it is particularly advantageous for the flowers to be positioned in close proximity to the cooling means 32 during shipment to maintain the flowers in as cool and fresh a condition as possible. Also, the flowers should be positioned within the housing in such a way that they extend to the free open space inside the housing 12 and do not come in contact with the side walls 16–20, bottom wall 14 or top 24 of the container 10 during shipment. It is also important that the cooling means or ice packs 32 be securely fixed in the container so as not to become dislodged and move about in the container and thereby damage the flowers.

In the method of using the shipping container of the present invention to ship a fresh bouquet of flowers, the ice packs 32, having been frozen in a conventional freezer, are removed from the freezer and installed in the recess 26 in the bottom wall of the housing 12. The strap pairs 40–41, 42–43 and 44–45 are wrapped about the ice packs and secured to one another as shown in FIG. 1. The handle 58 or other element of the floral arrangement or bouquet is inserted in the folded over pad 62 as shown in FIG. 2 and the pad is positioned in an appropriate location on the central strap 40 with the hook-and-loop fabrics 52, 68 engaging. Thereafter the transverse strap pairs 68–69, 70–71, 72–73 are securely wrapped about the pad 62 and holder 54 as shown in FIGS. 3 and 4. The cover 24 is then pivoted closed (if hinged) or placed upon the open end of the housing and a sealing and insulating tape, such as "duct tape", is wrapped about the seam between the housing and cover as shown by the phantom lines in FIG. 1. The container 10 is then ready for shipment.

Although certain presently preferred embodiments of the invention have been described herein, it will be apparent to those skilled in the art to which the invention pertains that variations and modifications of the described embodiment may be made without departing from the true spirit and scope of the invention. Accordingly, it is intended that the invention be limited only to the extent required by the appended claims and the applicable rules of law.

What I claim is:

1. A shipping container for shipping a floral arrangement or the like comprising:

an insulated housing including a bottom wall having a recess, side walls and a cover;

cooling means for maintaining the freshness of the floral arrangement during shipment, said cooling means comprising at least one ice substitute pack disposed in said recess;

means for restraining said ice substitute pack in said housing to prevent movement thereof during shipment; and means for restraining the floral arrangement in said housing in proximity to said cooling means with the flowers thereof spaced from said housing to prevent damage to the flowers during shipment, said means for restraining the floral arrangement being secured to said means for restraining the ice substitute pack.

2. A shipping container for shipping a floral arrangement or the like comprising:

an insulated housing having a bottom wall, side walls and a cover;

cooling means for maintaining the freshness of the floral arrangement during shipment;

means for restraining said cooling in said housing to prevent movement thereof during shipment, said means for restraining the cooling means comprises a plurality of first straps fixed to the housing, said first straps having fasteners for securing the first straps together about the cooling means; and means for restraining the floral arrangement in said housing in proximity to said cooling means with the flowers thereof spaced from said housing to prevent damage to the flowers during shipment.

3. The shipping container of claim 2 wherein said fasteners comprise hook-and-loop fabric fasteners.

4. The shipping container of claim 2 wherein said means for restraining the floral arrangement comprises a mounting means for gripping a portion of the floral arrangement, second straps connected to at least one of said first straps for securing the mounting means in a position adjacent the cooling means.

5. The shipping container of claim 4 including fasteners on said second straps for securing the second straps together about said mounting means.

6. The shipping container of claim 5, wherein said fasteners comprise hook-and-loop fabric fasteners.

7. The shipping container of claim 4, including a hook-and-loop fabric fastener for securing the mounting means to one of said first straps.

8. The shipping container of claim 4, wherein said mounting means comprises a resilient foam rubber pad.

9. The shipping container of claim 1, wherein said housing and cover are fabricated of a polystyrene foam plastic.

10. The shipping container of claim 2, including a plurality of anchoring means mounted to the bottom wall of the housing for securing said first straps to the housing.

11. The shipping container of claim 10, wherein said anchoring means comprise a plurality of tie-down bars, said first straps having loops engaging about said tie-down bars.

12. A shipping container for shipping a floral arrangement or the like comprising:

an insulated housing having a bottom wall, side walls and a cover;

cooling means for maintaining the freshness of the floral arrangement during shipment;

means for restraining said cooling means in said housing to prevent movement thereof during shipment; and means for restraining the floral arrangement in said housing in proximity to said cooling means with the flowers thereof spaced from said housing to prevent damage to the flowers during shipment, and wherein said floral arrangement is a wedding bouquet comprising a bouquet holder having a handle, said means for restraining the floral arrangement including means for gripping the handle of the bouquet holder.

13. The shipping container of claim 4, wherein at least one of said first straps is integrally formed with at least one of said second straps.

14. A shipping container for shipping a floral arrangement or the like comprising:

an insulated housing having a bottom wall, side walls and a cover;

cooling means for maintaining the freshness of the floral arrangement during shipment, said cooling means comprising a reusable and refreezable ice substitute pack;

means for restraining said cooling means in said housing to prevent movement thereof during shipment; and means for restraining the floral arrangement in said housing in proximity to said cooling means with the flowers thereof spaced from said housing to prevent damage to the flowers during shipment.

15. The shipping container of claim 4, wherein said first straps comprise at least three pair of straps, each strap being anchored to the bottom wall of the housing, said second straps comprising at least two pair of straps integrally formed with one of said first straps.

16. The shipping container of claim 14, wherein said floral arrangement is a wedding bouquet.

17. The shipping container of claim 16, wherein said wedding bouquet comprises a bouquet holder having a handle, said means for restraining the bouquet holder including means for gripping the handle of the bouquet holder.

18. The shipping container of claim 14, wherein said means for restraining the cooling means and said means for restraining the floral arrangement comprise hook-and-loop fabric fasteners.

19. The shipping container of claim 14, wherein said fasteners comprise straps and means for anchoring said straps to the bottom wall of said housing.

20. The shipping container of claim 14, wherein said housing and cover are fabricated of a polystyrene foam plastic.

* * * * *